US006600888B2

(12) United States Patent
Mishra et al.

(10) Patent No.: US 6,600,888 B2
(45) Date of Patent: Jul. 29, 2003

(54) LIQUID CHARGING METHOD AND APPARATUS

(75) Inventors: Satchidanand Mishra, Webster, NY (US); Zoran D. Popovic, Mississauga (CA); Anthony M. Horgan, Pittsford, NY (US); Robert C. U. Yu, Webster, NY (US); Geoffrey M. T. Foley, Fairport, NY (US); Huoy-Jen Yuh, Pittsford, NY (US); Eugene A. Swain, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/001,023

(22) Filed: Nov. 2, 2001

(65) Prior Publication Data

US 2003/0086724 A1 May 8, 2003

(51) Int. Cl.[7] ..... G03G 15/02
(52) U.S. Cl. ..... 399/174; 399/168
(58) Field of Search ..... 399/50, 168, 174, 399/175, 176; 361/225; 430/902

(56) References Cited

U.S. PATENT DOCUMENTS 3,835,355 A * 9/1974 Tsukada ..... 361/225 X
4,380,384 A * 4/1983 Ueno et al. ..... 399/176
5,378,526 A * 1/1995 Murata ..... 399/168 X
5,457,523 A 10/1995 Facci et al.
5,510,879 A * 4/1996 Facci et al. ..... 399/168
5,561,505 A * 10/1996 Lewis ..... 399/174 X
5,592,264 A * 1/1997 Shigeta et al. ..... 399/175
5,602,626 A * 2/1997 Facci et al. ..... 361/225 X
5,666,607 A * 9/1997 Camis ..... 399/176
5,781,833 A 7/1998 Lewis et al. ..... 399/168
5,819,141 A 10/1998 Facci et al. ..... 399/174
5,893,663 A 4/1999 Facci et al. ..... 399/168
5,895,147 A 4/1999 Facci et al. ..... 399/174
5,895,148 A 4/1999 Levy et al. ..... 399/174

FOREIGN PATENT DOCUMENTS

JP 57-49964 3/1982

OTHER PUBLICATIONS

Mishra et al., Ser. No. 09/659,260, "Liquid Charging Apparatus with Greater Contact Length".

* cited by examiner

*Primary Examiner*—Sandra Brase
(74) *Attorney, Agent, or Firm*—Zosan S. Soong

(57) ABSTRACT

A method including: (a) dispensing an electrically conductive liquid into a contact member permeable to the liquid; (b) rubbing the contact member and a surface against each other, at a contact length greater than a tangential contact length, to release the liquid from the contact member to wet the surface with the electrically conductive liquid in a layer ranging in thickness from about 1 to about 100 micrometers; and (c) electrifying the liquid at any time effective for imparting an electrical charge to the surface.

20 Claims, 5 Drawing Sheets

LIQUID CHARGING METHOD AND APPARATUS

BACKGROUND OF THE INVENTION

A prior art liquid charging apparatus is disclosed in Facci et al., U.S. Pat. No. 5,893,663 (hereinafter "Facci Patent"). An elevational schematic view of the liquid charging apparatus of the Facci Patent is shown in FIG. 1 (which corresponds to FIG. 1 of the Facci Patent). FIG. 1 shows a hydrophilic web 100 wound onto a supply roll 110 and a take-up roll 120. The web 100 is passed over a wetting or moistening device such as a porous roll 130. The porous roll contains a perforated shaft 131 therethrough. A DC voltage 135 is attached to the shaft to provide charge thereto. The DC voltage can be applied to the electrically conductive liquid by a conductive brush, commutator, wire, or similar device. This voltage application contact can occur at a reservoir, delivery tubing, porous roll, central roller or the wetted section of the web. The porous roll 130 uniformly moistens the web 100. As copies are made, the web 100 which is initially wound onto the supply roller 110, is slowly advanced or indexed in a direction (shown by arrow 111) counter to the photoreceptor 10 motion (shown by arrow 16), ensuring that any contamination at the entrance nip 17 is kept to a minimum as it is carried away by the web 100. Also, the contamination is kept out of the nip 18. The charging web 100 is contacted against the photoreceptor 10 by a contact roll 130 which supplies a charging fluid to the web 100 at a controlled rate. The fluid delivery member (or conduit) 51, from the reservoir 140, ensures an even contact pressure across the width of the photoreceptor 10. The width of the contact pad 130 determines the nip width.

In FIG. 1, photoreceptor 10 (which is a drum according to the Facci Patent) contacts the web 100 to result in a tangential contact length. As used herein, the phrase "contact length" refers to the distance in the process direction that two surfaces contact. The phrase "process direction" means the direction of motion of the surface (e.g., photoreceptor) to be charged. The phrase "tangential contact length" refers to two surfaces that slightly contact one another, that is, where the contact length is short. Besides the tangential contact length depicted in FIG. 1, another illustration of a tangential contact length is if photoreceptor 10 in FIG. 1 were a belt where web 100 contacts the linear surface of photoreceptor 10 to result in a short contact length. A tangential contact length depends for instance on the size of the two contacting surfaces. For purposes of discussion, however, a tangential contact length in the context of a nip formed by the contact of web 100 with photoreceptor 10 (whether photoreceptor 10 has the configuration of a belt, a drum or other conventional shape), is one ranging from 1 mm to 5 mm.

A contact length which is tangential is problematic for a liquid charging apparatus in a electrostatographic printing machine because the tangential contact length may lead to nonuniform charging due to variations in the degree of contact between the the charging apparatus and the surface to be charged. In addition, toner particles stuck under the liquid charging apparatus with a tangential contact length may give rise to nonuniform charging. Thus, there is a need for an improved liquid charging method and apparatus which avoid or minimize the problems discussed above.

Conventional liquid charging devices are also disclosed in Tajima et al., JP 57-49964; Facci et al., U.S. Pat. No. 5,457,523; Lewis et al., U.S. Pat. No. 5,781,833; Facci et al., U.S. Pat. No. 5,895,147; Facci et al., U.S. Pat. No. 5,819, 141; and Levy et al., U.S. Pat. No. 5,895,148, the disclosures of which are totally incorporated herein by reference.

SUMMARY OF THE INVENTION

The present invention is accomplished in embodiments by providing a method comprising:

(a) dispensing an electrically conductive liquid into a contact member permeable to the liquid;

(b) rubbing the contact member and a surface against each other, at a contact length greater than a tangential contact length, to release the liquid from the contact member to wet the surface with the electrically conductive liquid in a layer ranging in thickness from about 1 to about 100 micrometers; and (c) electrifying the liquid at any time effective for imparting an electrical charge to the surface.

There is also provided in embodiments an electrostatographic printing machine comprising:

(a) a photoreceptor;

(b) a developer member including toner particles;

(c) a dispensing equipment that dispenses an electrically conductive liquid;

(d) a contact member that receives the liquid and is permeable to the liquid, where the contact member and the photoreceptor rub against each other, at a contact length greater than a tangential contact length, to release the liquid from the contact member to wet the photoreceptor surface with the electrically conductive liquid in a layer ranging in thickness from about 1 to about 100 micrometers; and (e) a power source that electrifies the liquid.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
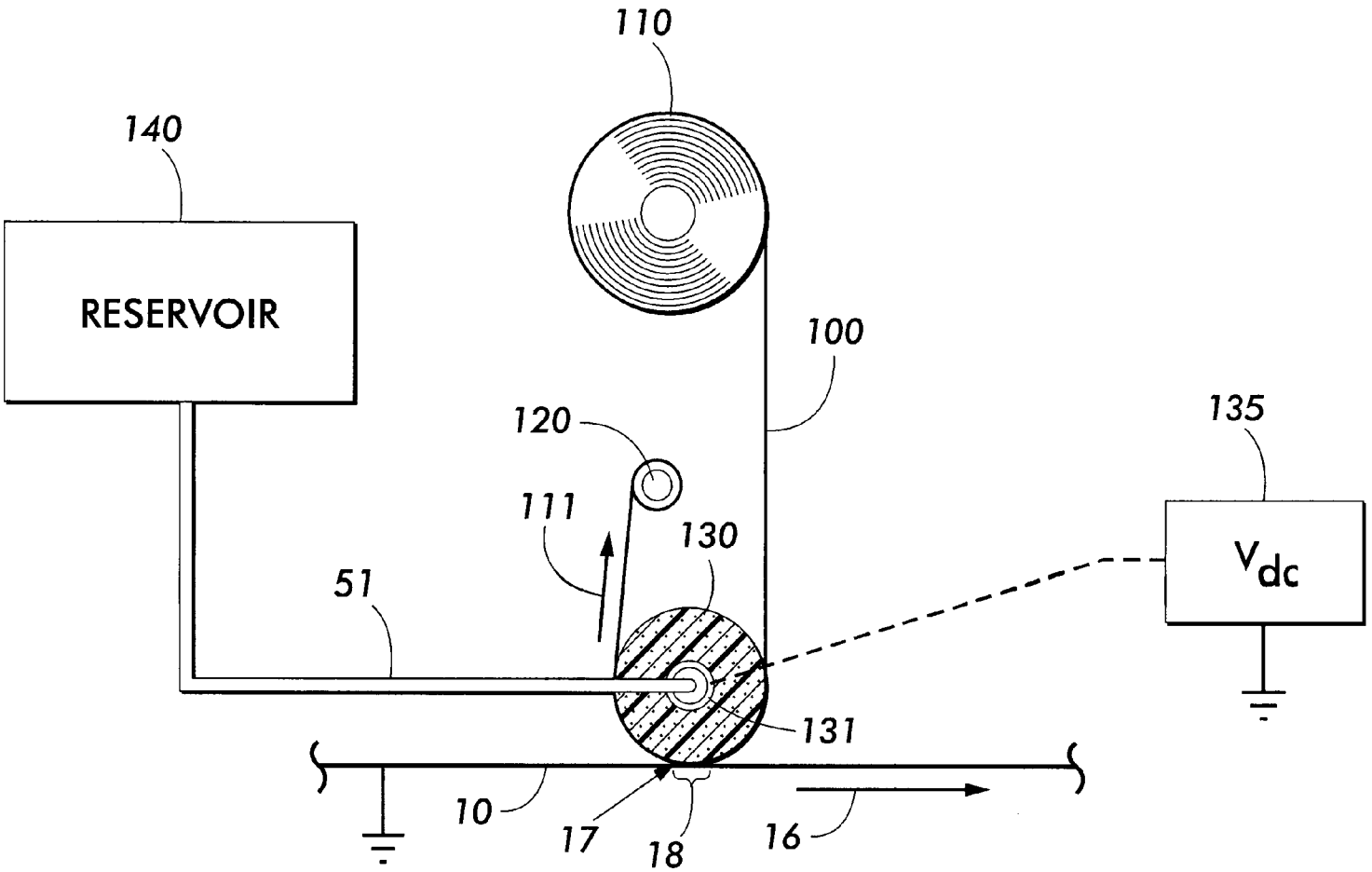
FIG. 1 PRIOR ART
FIG. 1 is a schematic, elevational view of a prior art charging apparatus.
Figure 2:
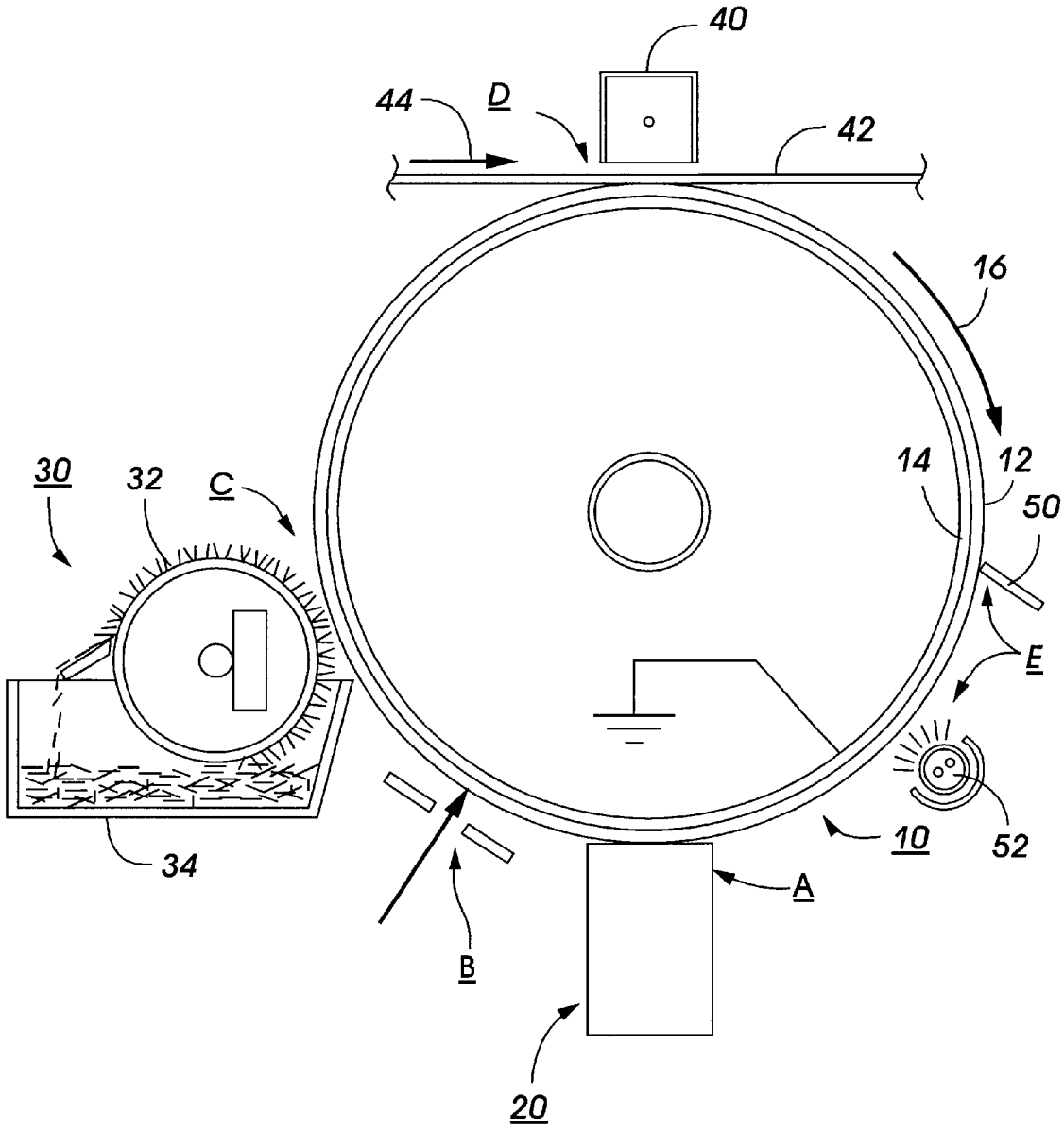
FIG. 2 is a schematic, elevational view of an electrostatographic printing machine incorporating the present charging apparatus.

Referring initially to FIG. 2 prior to describing the invention in detail, a schematic depiction of the various components of an exemplary electrostatographic printing machine incorporating the fluid media charging apparatus of the present invention is provided. Although the apparatus of the present invention is particularly well adapted for use in an electrophotographic printing machine, it will become apparent from the following discussion that the present fluid media charging apparatus is equally well suited for use in a wide variety of electrostatographic printing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic printing machine since such subsystems also require the use of a charging device.

The exemplary electrostatographic printing machine of FIG. 2 employs a photoreceptor 10 including a photoconductive surface 12 deposited on an electrically grounded conductive substrate 14. Photoreceptor 10 is depicted as a drum. A motor (not shown) engages with photoreceptor 10 for rotating the photoreceptor 10 to advance successive portions of photoconductive surface 12 in the direction of arrow 16 through various processing stations disposed about the path of movement thereof, as will be described.

Initially, a portion of photoreceptor 10 passes through charging station A. At charging station A, a charging apparatus in accordance with the present invention, indicated generally by reference numeral 20, charges the photoconductive surface 12 on photoreceptor 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto photoreceptor 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, photoreceptor 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, photoreceptor 10 advances the developed image to transfer station D, where a sheet of support material 42 is moved into contact with the developed toner image via a sheet feeding apparatus (not shown). The sheet of support material 42 is directed into contact with photoconductive surface 12 of photoreceptor 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging apparatus of the present invention can be substituted for the corona generating device 40 for providing the electrostatic charge which induces toner transfer to the support substrate material 42. The support material 42 is subsequently transported in the direction of arrow 44 for placement onto a conveyor (not shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of photoreceptor 10, some residual developing material remains adhered to the photoconductive surface 12. Thus, a final processing station, namely cleaning station E, is provided for removing residual toner particles from photoconductive surface 12 subsequent to separation of the support material 42 from photoreceptor 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp 52 for flooding the photoconductive surface 12 with light in order to dissipate any residual electrostatic charge remaining thereon in preparation for a subsequent imaging cycle. The present invention may also be utilized as a substitute for such a discharge lamp to counter any residual electrostatic charge on the photoconductive surface 12.

The present invention is an improved aquatron (i.e., a liquid charging apparatus) and a method for using the improved aquatron to enhance performance. An aquatron is an ozone-free contact charging device that is based on electrification of a water (or other liquid) moistened member in contact with a surface. Its advantage over other contact charging techniques is that it provides excellent charging uniformity over a wide range of process speeds, e.g., to 50 inches per second and is DC-only. It is nearly 100% efficient, operating at near theoretical voltage and current levels. It is also capable of a very small footprint. In order to obtain long term image quality it is necessary to ensure both uniform delivery of water to the contact member and to minimize contamination to this contact member. Contamination is caused by toner that passes by the cleaning blade/brush and by paper fibers and fillers.

Figure 3:
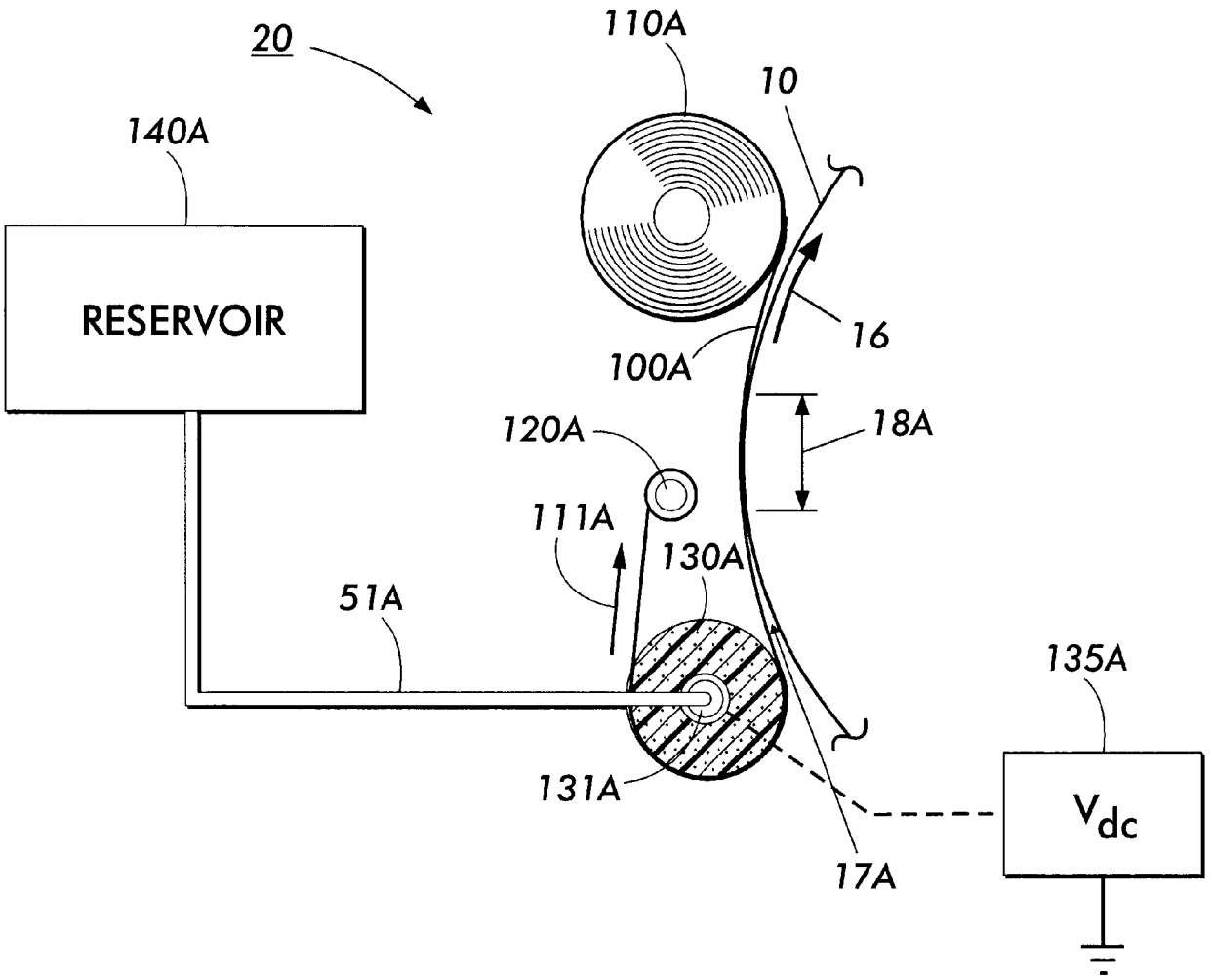
FIG. 3 is a schematic, elevational view of one embodiment of the present charging apparatus.

An elevational, schematic view of one embodiment of the present charging apparatus 20 is shown in FIG. 3. FIG. 3 shows a web 100A (preferably hydrophilic) in the configuration of a scroll wound onto a supply roll 110A and a take-up roll 120A. Web 100A is one embodiment of a contact member. The web 100A is passed over a wetting or moistening device such as a porous roll 130A. The porous roll contains a perforated shaft 131A therethrough. A DC voltage 135A (also referred herein as a power source) is attached to the shaft 131A to provide charge thereto. The DC voltage can be applied to the electrically conductive liquid by a conductive brush, commutator, wire, or similar device. This voltage application contact can occur at a reservoir, delivery tubing, porous roll, central roller or the wetted section of the web. The applied voltage ranges for example from about 100 V to about 2,000 V, more typically from about 400 V to about 1,000 V. The porous roll 130A uniformly moistens the web 100A. There are other ways of wetting or moistening the web, the porous roll is one example. As copies are made, the web 100A which is initially wound onto the supply roller 110A, is slowly advanced or indexed in a direction (shown by arrow 111A) counter to the photoreceptor 10 motion (shown by arrow 16), ensuring that the contamination (e.g., residual toner particles, paper debris, talc and other such elements in the machine) at the entrance 17A to contact length 18A is kept to a minimum as it is carried away by the web 100A. Also, the contamination is kept out of the contact length 18A. The indexing/advancing motion of the web is much slower than the process speed and can be driven by gearing down from the photoreceptor drive or using an independent motor drive. This indexing/advancing motion is calculated using the formula 1000/v, where v is the process speed. Process speed v ranges for example from about 2 inches per second to about 50 inches per second. The preferred rate of advance ranges from about 0.1 multiplied by (1000/v) to about 10 multiplied by (1000/v). The rate of advancement is controlled by the rate at which contamination accumulates on the web 100A. Experience with contamination suggests that an advancement rate of 1.0 cm per kilocopy should be sufficient, assuming a contact length of 1.0 inch. This leads to a web usage of about four (4) feet in 100,000 (one hundred thousand) copies. A further advantage of the web is that the scratching of the photoreceptor and wear can be minimized because the abrasive toner is removed from the contact length 18A. The cleaning action of the web 100A might actually decrease image noise as well. As seen in FIG. 3, a length of the web 100A between supply roll 110A and porous roll 130A is wrapped about a portion of photoreceptor 10 to form contact length 18A. The positions of supply roll 110A and/or porous roll 130A may be continuously adjusted such that 110A and 130A are preferably held at a constant distance from the surface of photoreceptor 10, which keeps fixed the length of the web 100A between 110A and 130A.

The porous roll 130A supplies an electrically conductive liquid to the web 100A at a controlled rate. For example, the rate of moisture delivery can be actively controlled by a sensor and a pump as described in Facci et al., U.S. Pat. No. 5,819,141, the disclosure of which is totally incorporated herein by reference. Liquid flow to the web can also be actively regulated by pumping at a predetermined rate. The fluid delivery member (or conduit) 51A, from the reservoir 140A, ensures an even contact pressure across the width of the photoreceptor 10. The width of the porous roll 130A determines the width of the contact length. A web aquatron is useful for a mid-volume machine, high volume machine, and a production machine where a large amount of contamination can accumulate because of high average monthly print volume.

In FIG. 3, the dispensing equipment for the electrically conductive liquid includes shaft 131A, porous roll 130A, conduit 51A, and reservoir 140A. Alternatively, the electrically conductive liquid may be supplied by a pan positioned below the porous roll 130A where the porous roll 130A is partially immersed in the electrically conductive liquid. In another embodiment, the porous roll 130A could be wetted by a secondary wet roll, which also serves as a metering roll for the electrically conductive liquid.

Figure 4:
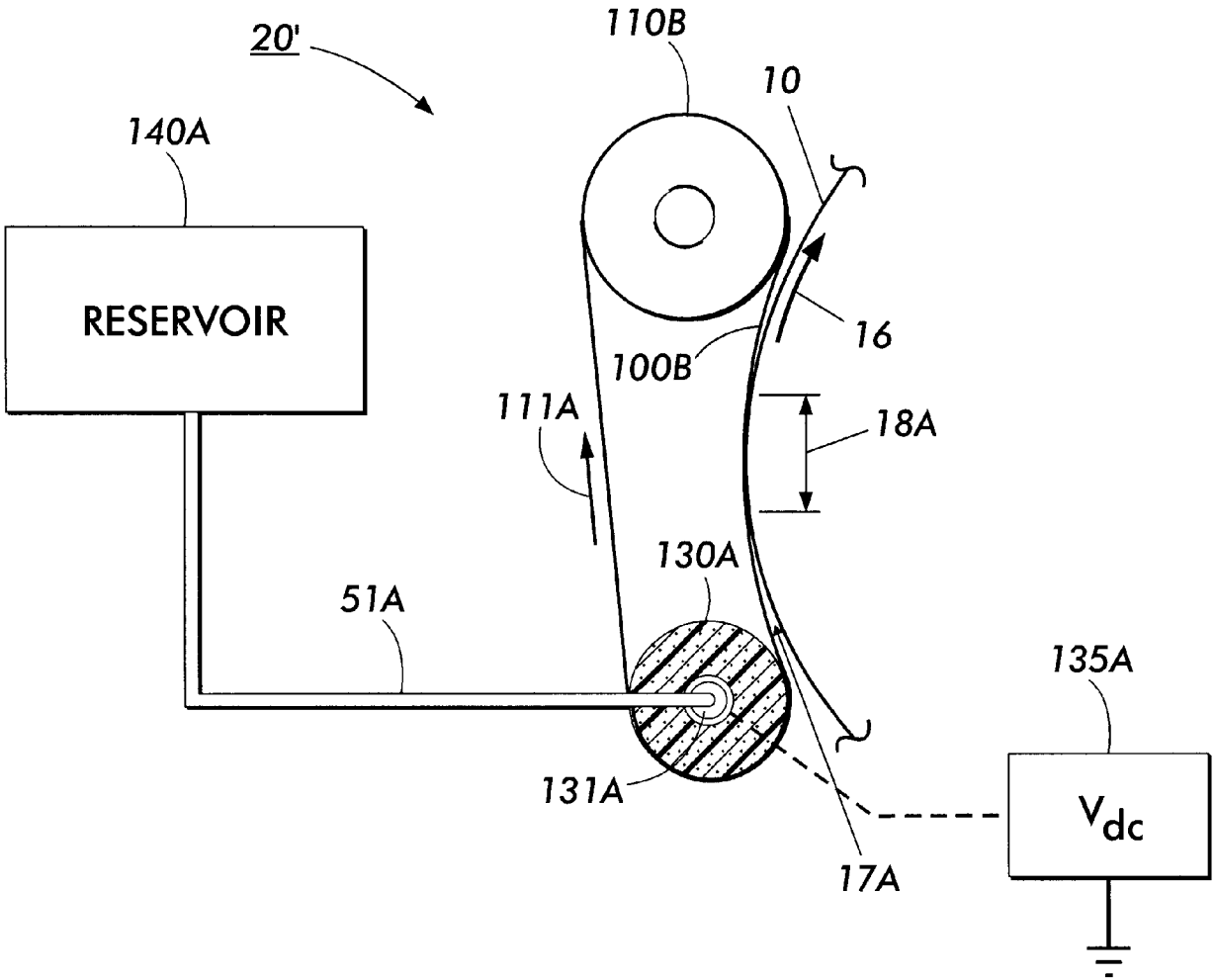
FIG. 4 is a schematic, elevational view of another embodiment of the present charging apparatus.

An alternative embodiment of the present charging apparatus 20 is depicted in FIG. 4 as charging apparatus 20' where the contact member is belt 100B, rotated by drive roll 110B. The discussion herein for the operation of the charging apparatus 20 of FIG. 3 generally applies to the operation of the charging apparatus 20' of FIG. 4. As seen in FIG. 4, a length of the belt 100B between drive roll 110B and porous roll 130A is wrapped about a portion of photoreceptor 10 to form contact length 18A. The positions of drive roll 110B and/or porous roll 130A may be continuously adjusted such that 110B and 130A are preferably held at a constant distance from the surface of photoreceptor 10, which keeps fixed the length of the belt 100B between 110B and 130A.

The porous roll 130A may be fabricated of any suitable liquid retentive material including for example an open cell foam such as a polyvinylalcohol based foam. The porous roll 130A may be a perforated metal roll filled with liquid retentive material or a porous fritted glass roll.

The contact member (i.e., 100A, 100B) is preferably a single layer of any suitable liquid permeable material having a thickness ranging from about 0.5 mm to about 2 cm. The contact member may be fabricated from a hydrophilic polymeric foam composed of for example polyvinyl alcohol, polyurethane, cellulose, or the like. In embodiments, the contact member is composed of two layers, a top layer of a liquid permeable material such as a hydrophilic polymeric foam composed of for example polyvinyl alcohol, polyurethane, or cellulose, and a bottom layer which is perforated and can be fabricated from a plastic or metal. The top layer may have a thickness ranging from about 0.5 mm to about 2 cm, preferably from about 1 mm to about 5 mm. The bottom layer may have a thickness ranging from about 100 micrometers to about 1 mm. In embodiments, the contact member swells up from absorbing the electrically conductive liquid, where such swelling spontaneously results from the hydrophilic interaction between the contact member and the electrically conductive liquid. It is optional in the present invention to employ capillary action to pull the liquid into the contact member.

The electrically conductive liquid can be water such as carbonated water or distilled water (the distilled water preferably contains ions that result from sufficient exposure of the distilled water with the atmosphere to produce the ions). In addition, the electrically conductive liquid can be an alcohol such as an aliphatic alcohol (e.g., methanol, ethanol, and propanol) and an alicyclic alcohol (e.g., cyclohexanol), or a water/alcohol mixture in any effective proportion ranging for example from about 90% (water)/10% (alcohol) to about 10% (water)/90% (alcohol) by volume. Any ion imparting aqueous solution may be used which does not leave a residue and which does not chemically react with the photoreceptor. Optionally, solid electrolytes can be dissolved into the electrically conductive liquid; in embodiments, there is no need to dissolve solid electrolytes into the liquid. The solid electrolytes can be for example carbonates such as sodium carbonate, sodium bicarbonate, chlorides such as copper chloride, nitrates such as sodium nitrate, and the like. The liquid may have an electrical conductivity ranging for example from about 100 to about $10^{12}$ ohms/sq, particularly from about $10^{3}$ to about $10^{9}$ ohms/sq.

In embodiments, the electrically conductive liquid readily evaporates, leaves no residue after evaporation, and does not penetrate or react with the surface (e.g., photoreceptor). Timely evaporation of the liquid is desirable in certain embodiments such as before the photoreceptor arrives under the exposure station in a xerographic printing machine; otherwise the presence of the electrically conductive liquid on the photoreceptor may interfere with the exposure step. A layer of the electrically conductive liquid having the thickness described herein may substantially evaporate or completely evaporate in a time ranging for example from about 10 to about 500 milliseconds, and particularly from about 25 to about 300 milliseconds. This evaporation time is based on an air temperature of about 25 degrees C.; a surface (e.g., photoreceptor) temperature of about 50 to about 120° F., particularly from about 70 to about 105° F.; and a humidity level ranging from about 5% to about 80%, particularly from about 20% to about 60%.

Rubbing of the contact member and the surface against each other releases the electrically conductive liquid from the contact member to wet the surface with the electrically conductive liquid in a layer ranging in thickness from about 1 to about 100 micrometers, particularly from about 5 to about 50 micrometers. The term "wet" or "wetting" indicates that the liquid is able to form a film over the surface. The layer of the electrically conductive liquid on the surface may have a relatively non-uniform thickness or a relatively uniform thickness. Electrical charging of the surface will still occur even for those embodiments where there are one or more small gaps in the liquid layer (i.e., where no liquid is present in a particular spot on the surface); however, such gaps in the liquid layer may result in uneven charging. Thus, it is preferred although not required for the liquid layer to be complete, i.e., contain no gaps.

Wetting the surface with a layer of the electrically conductive liquid facilitates the removal of contaminants (e.g., dirt, debris and residual toner particles) from the surface by the contact member, i.e., wetting enhances the cleaning function of the contact member since wetting allows loosening, lifting, and dislodging of the contaminants residing on the surface. In embodiments, the wetting process also provides uniform deposition of charged ions onto the surface.

Rubbing the contact member and the surface can be accomplished by any method creating relative movement between the contact member and the surface. For example, the contact member and the surface can move in opposite directions. Also, the contact member and the surface can move in the same direction, but with one of the two moving at a slower rate than the other. Furthermore, one of the contact member and the surface can be stationary, while the other moves.

The power source electrifies the electrically conductive liquid at any time effective for imparting an electrical charge to the surface. For example, electrifying the liquid can occur prior to rubbing the contact member and the surface against each other.

Figure 5:
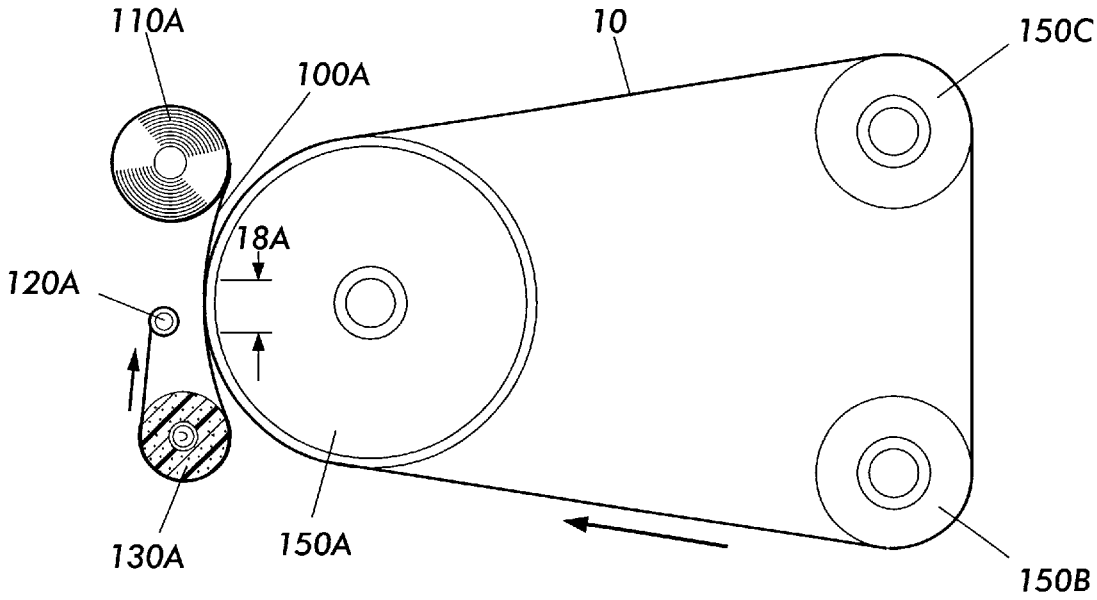
FIG. 5 is a schematic, elevational view of the charging apparatus of FIG. 3 engaged with a belt photoreceptor supported by three rolls.

Any configuration of the photoreceptor (or other component such as a toner transfer member to be charged by the present charging apparatus) may be employed. For example, FIG. 5 depicts the charging apparatus of FIG. 3 where photoreceptor 10 has the configuration of a belt supported by three rolls (150A, 150B, 150C). One or more of these rolls may be a drive roll. Roll 150A presses photoreceptor 10 against contact member 100A in the form of a web. As seen in FIG. 5, a length of the web 100A between supply roll 110A and porous roll 130A is wrapped about a portion of photoreceptor 10 to form contact length 18A. The positions of supply roll 110A and/or porous roll 130A may be continuously adjusted such that 110A and 130A are preferably held at a constant distance from the surface of photoreceptor 10, which keeps fixed the length of the web 100A between 110A and 130A.

Figure 6:
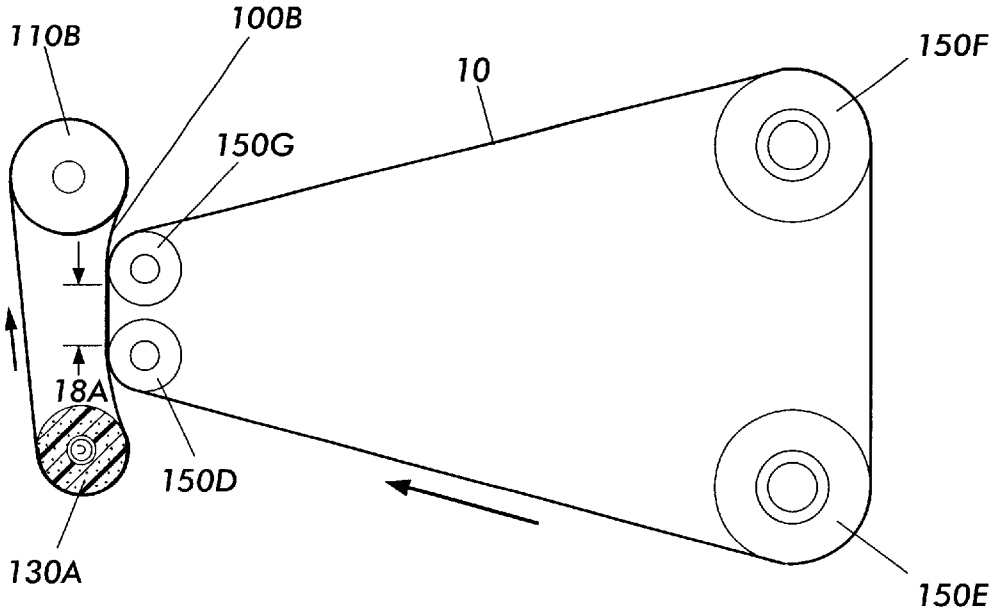
FIG. 6 is a schematic, elevational view of the charging apparatus of FIG. 4 engaged with a belt photoreceptor supported by four rolls.

FIG. 6 depicts the charging apparatus of FIG. 4 where photoreceptor 10 has the configuration of a belt supported by four rolls (150D, 150E, 150F, 150G). One or more of these rolls may be a drive roll. Rolls 150D and 150G press photoreceptor 10 against contact member 100B. As seen in FIG. 6, a length of the belt 100B between drive roll 110B and porous roll 130A is wrapped about a portion of photoreceptor 10 to form contact length 18A. The positions of drive roll 110B and/or porous roll 130A may be continuously adjusted such that 110B and 130A are preferably held at a constant distance from the surface of photoreceptor 10, which keeps fixed the length of the belt 100B between 110B and 130A.

In FIGS. 2–6, a non-rotating backer bar may be used in place of any roll or rolls used to facilitate movement of the contact member and the photoreceptor.

The force or pressure exerted by the contact member on the surface (e.g., photoreceptor) along the contact length ranges for example from about 1 to 100 grams per linear cm width, particularly from about 10 to about 25 grams per linear cm width.

The advantage of the present charging apparatus is that the contact length is greater than a tangential contact length resulting in a more uniform charging due to less variation in the degree of surface contact. In addition, the present charging apparatus can remove toner particles thereby minimizing the problem of nonuniform charging due to residual toner particles stuck under the liquid charging apparatus. With the present charging apparatus, the contact length may be for example at least about 7 mm, preferably from about 7 mm to about 5 cm, and more preferably from about 10 mm to about 3 cm. As seen for example in FIGS. 5 and 6, the contact member section and the surface section (of for example the photoreceptor) corresponding to the contact length 18A may be curved or linear.

In embodiments, the present charging apparatus performs solely a charging function without being involved in removal of residual toner particles from the photoreceptor (or from another component to be charged by the present charging apparatus). In these embodiments, any residual toner particles, on for example the photoreceptor or other toner receiving surface, may be removed by one or more conventional cleaning devices.

In other embodiments, the present charging apparatus performs both a charging function and a residual toner particle removal function. In these other embodiments, charging occurs along the entire contact length. The removal of residual toner particles may occur along the entire contact length, but it is possible that all residual toner particles are removed in less than the entire contact length such that only the charging function is performed in the remainder of the contact length. Residual toner particles are removed by the rubbing contact of the contact member and the photoreceptor. The contact member may be replaced when it is full of residual toner particles. Thus, in certain embodiments, the contact length is composed of: a first contact length section where both charging and removal of residual toner particles occur; and a second contact length section where charging occurs but no removal of residual toner particles occurs since such residual toner particles are removed in the first contact length section. Preferably, the second contact length section is longer than the first contact length section.

Other modifications of the present invention may occur to those skilled in the art based upon a reading of the present disclosure and these modifications are intended to be included within the scope of the present invention.

We claim:

1. A method comprising:

(a) dispensing an electrically conductive liquid into a contact member permeable to the liquid wherein the contact member is a web or an endless belt;

(b) rubbing the contact member and a surface against each other, at a contact length greater than a tangential contact length, to release the liquid from the contact member to wet the surface with the electrically conductive liquid in a layer ranging in thickness from about 1 to about 100 micrometers; and (c) electrifying the liquid at any time effective for imparting an electrical charge to the surface.

2. The method of claim 1, wherein the force exerted by the contact member on the surface along the contact length ranges from about 1 to about 100 grams per linear cm width.

3. The method of claim 1, wherein the contact member is an endless belt.

4. The method of claim 1, wherein the liquid is selected from the group consisting of water, an alcohol, and a water/alcohol mixture.

5. The method of claim 1, wherein the liquid consists of distilled water.

6. The method of claim 1, wherein the contact length is at least about 7 mm.

7. The method of claim 1, wherein the contact length ranges from about 10 mm to about 3 cm.

8. The method of claim 1, wherein the liquid layer ranges in thickness from about 5 to about 50 micrometers.

9. The method of claim 1, wherein the electrifying of the liquid occurs prior to the rubbing the contact member and the surface against each other.

10. The method of claim 1, wherein the surface is a photoreceptor.

11. The method of claim 1, wherein the rubbing the contact member and a surface is accomplished by moving the contact member and the surface in opposite directions.

12. An electrostatographic printing machine comprising:

(a) a photoreceptor;

(b) a developer member including toner particles;

(c) a dispensing equipment that dispenses an electrically conductive liquid;

(d) a contact member that receives the liquid and is permeable to the liquid, wherein the contact member is a web or an endless belt, where the contact member and the photoreceptor rub against each other, at a contact length greater than a tangential contact length, to release the liquid from the contact member to wet the photoreceptor surface with the electrically conductive liquid in a layer ranging in thickness from about 1 to about 100 micrometers; and (e) a power source that electrifies the liquid.

13. The machine of claim 12, wherein the force exerted by the contact member on the photoreceptor along the contact length ranges from about 1 to about 100 grams per linear cm width.

14. The machine of claim 12, wherein the contact member is an endless belt.

15. The machine of claim 12, wherein the liquid is selected from the group consisting of water, an alcohol, and a water/alcohol mixture.

16. The machine of claim 12, wherein the liquid consists of distilled water.

17. The machine of claim 12, wherein the contact length is at least about 7 mm.

18. The machine of claim 12, wherein the contact length ranges from about 10 mm to about 3 cm.

19. The machine of claim 12, wherein the liquid layer ranges in thickness from about 5 to about 50 micrometers.

20. The machine of claim 12, wherein the contact member and the photoreceptor accomplish the rubbing by moving in opposite directions.

* * * * *